US008136902B2

(12) United States Patent
Miyagi et al.

(10) Patent No.: US 8,136,902 B2
(45) Date of Patent: Mar. 20, 2012

(54) IMAGE FORMING APPARATUS

(75) Inventors: Takashi Miyagi, Miyagi (JP); Naoki Okazaki, Miyagi (JP); Wataru Takahashi, Miyagi (JP); Yoshinari Suzuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 343 days.

(21) Appl. No.: 12/574,966

(22) Filed: Oct. 7, 2009

(65) Prior Publication Data

US 2010/0091056 A1 Apr. 15, 2010

(30) Foreign Application Priority Data

Oct. 14, 2008 (JP) ..... 2008-264817

(51) Int. Cl.
*B41J 29/38* (2006.01)

(52) U.S. Cl. ..... 347/9

(58) Field of Classification Search ..... 347/9, 16, 347/101, 102, 104
See application file for complete search history.

(56) References Cited

U.S. PATENT DOCUMENTS

| | | | | |
|---|---|---|---|---|
| 7,172,263 | B2 * | 2/2007 | Takatsuka et al. | 347/32 |
| 7,562,961 | B2 * | 7/2009 | Inoue | 347/35 |

FOREIGN PATENT DOCUMENTS

| | | |
|---|---|---|
| JP | 2817964 | 8/1998 |
| JP | 2003-341106 | 12/2003 |
| JP | 2004-74637 | 3/2004 |
| JP | 2006-21400 | 1/2006 |
| JP | 2006-69135 | 3/2006 |
| JP | 2007-152612 | 6/2007 |
| JP | 2007-168277 | 7/2007 |
| JP | 4020105 | 10/2007 |

* cited by examiner

*Primary Examiner* — An Do

(74) *Attorney, Agent, or Firm* — Cooper & Dunham LLP

(57) ABSTRACT

An image forming apparatus includes a recording head including heads containing arranged nozzles to discharge a droplet, the heads are arranged in a zigzag form along a nozzle array direction; a conveyer belt with suction holes to convey a printing medium in a direction intersecting a head array direction; and a control unit to control an blank discharging; wherein suction hole arrays including the suction holes arranged in the head array direction, are arranged at a predetermined interval; wherein one of the suction hole arrays is a reference suction hole array including the suction hole to pass a position facing the nozzle of a nozzle array end and the nozzle in an overlapping part of two heads in the nozzle array direction; and wherein the control unit makes each nozzle discharge a blank discharging droplet to the suction holes, using the reference suction hole array as a standard.

4 Claims, 13 Drawing Sheets

FIG.11

| T2 | BLANK DISCHARGE DATA |
|---|---|
| (4/16)T3 | DATA STARTING FROM A1 |
| (5/16)T3 | DATA STARTING FROM B1 |
| (6/16)T3 | DATA STARTING FROM A2 |
| (7/16)T3 | DATA STARTING FROM B2 |
| (8/16)T3 | DATA STARTING FROM A3 |
| (9/16)T3 | DATA STARTING FROM B3 |
| (10/16)T3 | DATA STARTING FROM A4 |
| (11/16)T3 | DATA STARTING FROM B4 |
| (12/16)T3 | DATA STARTING FROM A5 |
| (13/16)T3 | DATA STARTING FROM B5 |
| (14/16)T3 | DATA STARTING FROM A6 |
| (15/16)T3 | DATA STARTING FROM B6 |
| (16/16)T3 | DATA STARTING FROM A7 |
| (17/16)T3 | DATA STARTING FROM B7 |
| (18/16)T3 | DATA STARTING FROM A8 |
| (19/16)T3 | DATA STARTING FROM B8 |

IMAGE FORMING APPARATUS

BACKGROUND OF THE INVENTION

1. Field of the Invention

The present invention relates to image forming apparatuses. More specifically, the present invention relates to an image forming apparatus with a recording head that discharges a droplet.

2. Description of the Related Art

As a liquid-discharge-recording-method image forming apparatus using a recording head that discharges an ink droplet, for example, an ink-jet recording apparatus is known. The ink-jet recording apparatus can be applied to an image formation apparatus including a printer, facsimile, duplicating apparatus, plotter and machine combining them. The liquid-discharge-recording-method image forming apparatus discharges an ink droplet to a carried paper sheet and forms an image on the paper sheet. Here the carried paper sheet includes not only a sheet of paper but also a sheet of OHP (i.e., Overhead Projector). The paper sheet means a medium to which the ink droplet and other liquid can adhere, and is called a recordable medium, a recording medium and a recording paper sheet. Also, "recording" and "printing" may be used as synonyms of the "image forming". The liquid-discharge-recording-method image forming apparatus includes two types of image forming apparatuses, a serial-type image forming apparatus that forms an image by discharging droplets while the recording head moves in the main scanning direction, and a line-type image forming apparatus that forms an image by discharging droplets in a state where the recording head does not move (i.e., head is still).

Moreover, in the present invention, the liquid-discharging-method "image forming apparatus" means an apparatus that forms an image by discharging a liquid onto a medium including paper, a thread, a fiber, a cloth, leather, metal, plastics, glass, wood, ceramic and others. Furthermore, "the image forming" means not only applying an image with meaning such as a character and a diagram to the medium, but also applying an image without meaning such as a pattern to the medium (i.e., just discharging droplets on the medium). In addition, "the ink" is used as a generic term of all liquids capable of image forming such as what is described as recording liquid, fixer solution and fixing liquid as well as what is described as ink. For example, the ink includes a DNA sample, resist, pattern materials and so on.

In such an image forming apparatus (which may be referred to as an "ink-jet recording apparatus" hereinafter), because the recording head discharges the ink from a nozzle onto the paper, the recording head goes into a discharge defect state due to an increase in ink viscosity caused by solvent evaporation from the nozzle, ink solidification, dust adherence to the ink, and even air bubble incorporation, which results in a recording defect.

Thus, in order to maintain a preferable ink droplet discharging state from the recording head, what is called a blank discharging operation, discharging an ink droplet that does not contribute to the image forming (i.e., a blank discharge droplet), is performed during a printing operation.

In case of the serial-type image forming apparatus, because recording is performed by moving the recording head, it is possible to set a position of the blank discharging on the outside of a paper conveying path used by a conveying unit to convey the paper and to perform the blank discharging on the outside of the conveying path in a process of back and forth movement of the recording head. Thus, interruption time of the printing operation is very short and a problem of decrease in print rate rarely happens.

On the other hand, in case of the line-type image forming apparatus that forms the image in a state where the recording head does not move (i.e., in a state where the recording head is fixed), if the blank discharging position is set on the outside of the paper conveying path, it is necessary to halt the printing operation and to move the recording head to the blank discharging position outside the paper conveying path, which causes a substantial time loss and prevents realization of continuous printing and quick printing.

Therefore, conventionally, as disclosed in Japanese Laid-Open Patent Application Publication No. 2007-168277 (which is hereinafter called a first patent document), a technique of an ink-jet recording apparatus configured to suction sheet material by suctioning air from a plurality of suction holes provided in a conveyer belt and to convey the sheet material to a print part by rotation of the conveyer belt, is known. In the configuration of the conventional technique disclosed in the first patent document, regarding all of the nozzles of every ink-jet head, any suction holes are set so as to pass printing positions of any nozzles. The ink is received by an ink receiving member through the suction holes by discharging the ink by the blank discharging after aligning the nozzles and the suction holes.

In case of using a recording head that includes a plurality of heads arranged in a zigzag formation in a direction almost perpendicular to the paper conveying direction, in ends of two heads, the heads are disposed so as to overlap the nozzles in a nozzle array direction, by which a deficit in a connection part between heads is prevented. Then, concerning the nozzles in the overlapping part created by such a zigzag arrangement, since the nozzles discharge the same color droplets, a control that alternately uses one of the two nozzles and discharges the droplet is generally performed. As a result, with regard to the nozzles in the overlapping part, a time elapsing from a discharge to the next discharge is longer than that of nozzles in the other (i.e., the non-overlapping part), which makes it relatively difficult to maintain a satisfactory discharging state of the nozzles disposed in the overlapping part preferable.

Moreover, the nozzles of the recording head are disposed even in an area that exceeds a maximum paper-sheet width capable of being conveyed, and a typical paper-sheet size is generally smaller than the maximum paper-sheet width. Hence, use frequency of the nozzles in both ends in the recording head decreases compared to the other nozzles, which requires that the discharging state of the nozzles in both ends is always kept satisfactory by performing discharge regularly.

In this case, like the conventional technique disclosed in the first patent document, even if the blank discharging is performed toward the suction holes provided to suction and convey the paper on the conveyer belt, the suction holes do not always pass in a proper timing, facing the nozzles in the overlapping part between each head or the nozzles in the both ends of the nozzle array in the recording head (when all of the nozzles are regarded as one nozzle array). In this case, the timing of the blank discharging by the nozzles in the overlapping part and the nozzles of both ends varies widely.

SUMMARY OF THE INVENTION

Accordingly, embodiments of the present invention may provide a novel and useful image forming apparatus solving or reducing one or more of the above-described problems.

More specifically, the embodiments of the present invention may provide an image forming apparatus whereby a nozzle of both ends of a nozzle array in a recording head or a nozzle of an overlapping part between each head can easily perform a blank discharging.

According to one embodiment of the present invention, an image forming apparatus is provided, the apparatus including:

a recording head including a plurality of heads, each of the heads including a plurality of arranged nozzles to discharge a droplet, wherein the plurality of heads are arranged in a zigzag formation with respect to an array direction of the nozzles;

a conveyer belt with a plurality of suction holes to convey a printing medium in a direction intersecting a head array direction;

a suction unit to suction the printing medium through the plurality of suction holes of the conveyer belt; and a control unit to control a blank discharging operation to discharge a blank discharging droplet not contributing to image forming from the nozzles when there is no printing medium on the conveyer belt;

wherein a plurality of suction hole arrays, each of the suction hole arrays including the plurality of suction holes arranged in the head array direction, are arranged at a predetermined interval;

wherein at least one of the plurality of suction hole arrays is a reference suction hole array including the suction hole to pass a position facing the nozzle of an end of a nozzle array and the nozzle in an overlapping part of two heads in the nozzle array direction; and wherein the control unit performs a control to make each nozzle in the recording head discharge the blank discharging droplet toward the suction holes, using the reference suction hole array as a standard.

Other objects, features and advantages of the present invention will become more apparent from the following detailed description when read in conjunction with the accompanying drawings.

BRIEF DESCRIPTION OF THE DRAWINGS

FIG. 11 is an illustration diagram to explain blank discharging data in the second embodiment of the present invention.

DETAILED DESCRIPTION OF THE PREFERRED EMBODIMENTS

Figure 1:
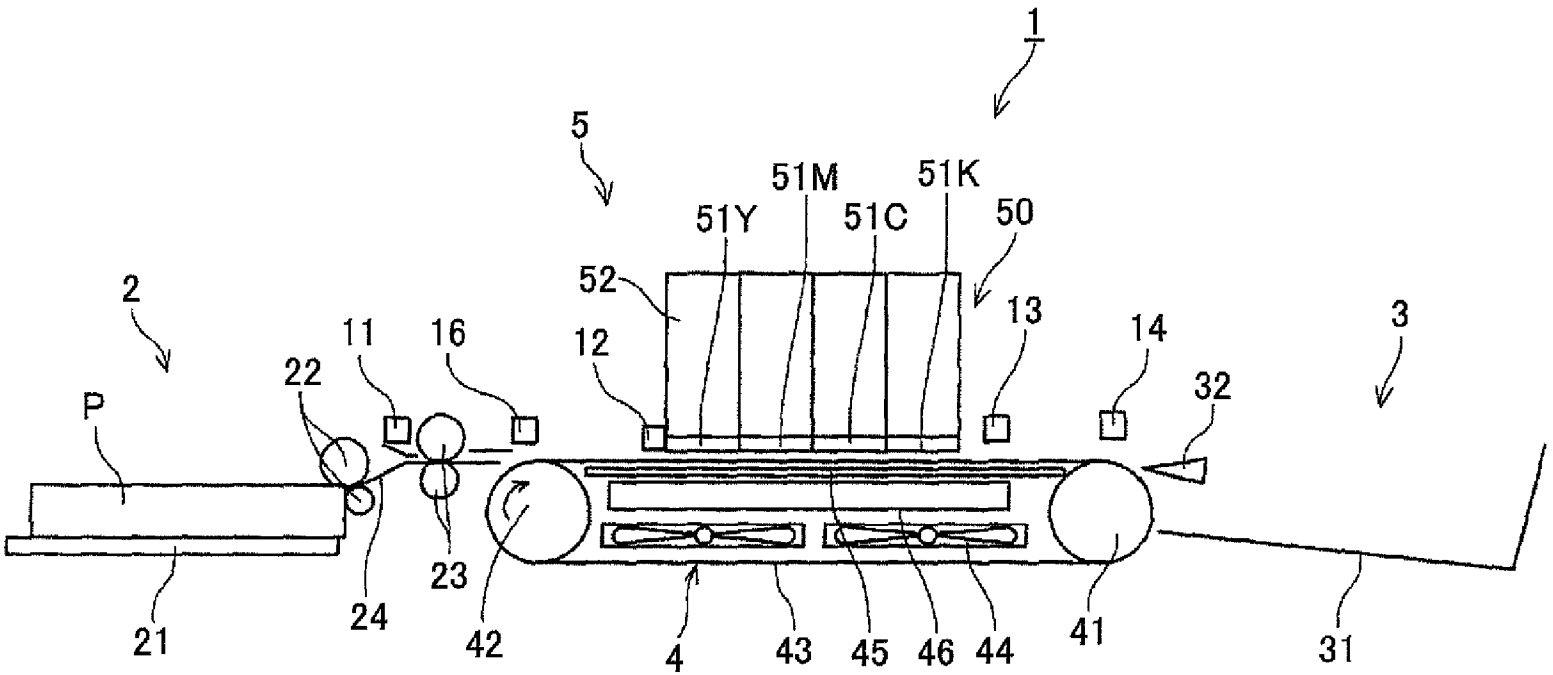
FIG. 1 is an outline configuration diagram to explain an overall configuration of an image forming apparatus in a first embodiment of the present invention.
Figure 2:
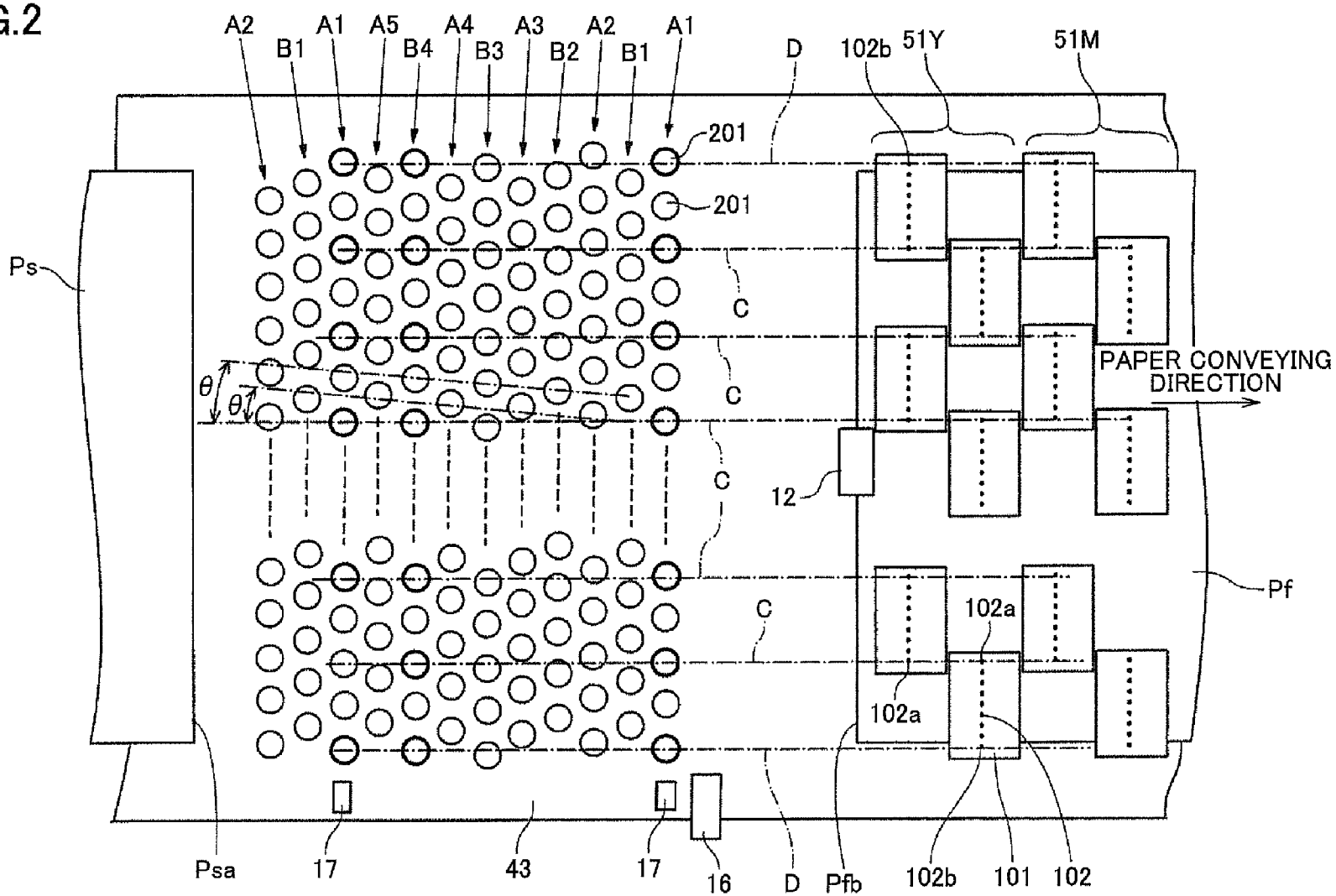
FIG. 2 is an outline plane illustration diagram of the image forming apparatus in the first embodiment of the present invention.

A description is given, with reference to the accompanying drawings, of embodiments of the present invention. To begin with, an explanation is given about an image forming apparatus in a first embodiment of the present invention, referring to FIG. 1 and FIG. 2. Here FIG. 1 is an outline configuration diagram to explain an overall configuration of the image forming apparatus. FIG. 2 is a main part plane illustration diagram to explain a configuration of the image forming apparatus. In addition, FIG. 2 shows nozzles in a recording head in a transparent state.

An image forming apparatus 1 is a line-type image forming apparatus and includes a paper feeding part 2 that loads and feeds a sheet of paper P (which is called hereinafter "a paper sheet P"), a paper ejection part 3 that ejects and takes in a printed paper sheet P, a conveying unit 4 that conveys the paper sheet P from the paper feeding part 2 to the paper ejection part 3, and an image forming unit 5 that discharges a droplet onto the paper sheet P carried by the conveying unit 4 and forms an image on the paper sheet P.

The paper feeding part 2 includes a paper feed tray 21 that loads the paper P, a pair of paper feed rollers 22 that separates each paper sheet P from the paper feed tray 21 and feeds the paper sheet P, a pair of resist rollers 23, and a guide member 24 that guides conveyance of the paper sheet P.

The paper ejection part 3 includes a jump board 32 in order to guide a bottom surface of the paper sheet P carried from a conveyor belt 43 and a paper catch tray 31 that takes in and holds the paper sheet P sent out by the jump board 32.

The conveyor unit 4 includes a conveyor belt 43 configured as an endless belt that is hung and wound around between a driving roller (i.e., conveyor roller) 41 and a driven roller 42, a suction unit 44 that suctions the paper sheet P on the conveyor belt 43 by suctioning air from a suction hole 201 such as a suction fan, a platen member (i.e., a deflection preventing member) 45 that supports the conveyor belt 43 from a back side in a position facing the image forming unit 45, a blank discharging ink receiver 46 that receives a discharged blank discharging droplet (i.e., waste liquid). The conveyor belt 43 conveys the paper sheet P from the left side to the right side in FIG. 1 by moving and rotating in a direction of an arrow, absorbing the paper sheet P by the air suction.

The image forming unit 5 includes a head module array 50 that contains line-type recording heads 51Y, 51M, 51C, 51K of four colors (which hereinafter may be called "a recording head 51" when the colors are not distinguished) to discharge four colors of ink droplets (i.e., Yellow Y, Magenta M, Cyan C, Black B) onto the paper sheet P conveyed by being suctioned and held on the conveyor belt 43, and a divaricating member 52 that distributes the inks from sub tanks not shown in FIG. 1 and FIG. 2.

Figure 3:
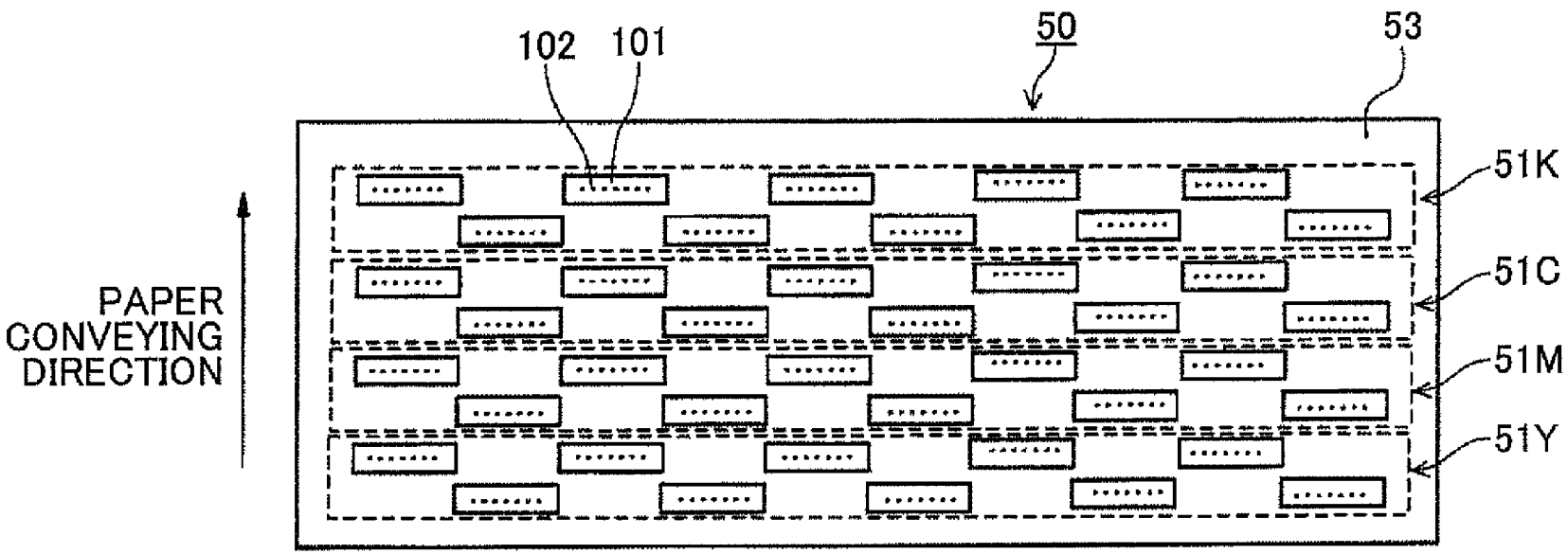
FIG. 3 is an illustration diagram showing an example of a head module in the first embodiment of the present invention.

Here as shown in FIG. 3, the head module array 50 of the image forming unit 5 includes a plurality of recording heads 51 of each color on a common base member 53. Each of the recording heads 51 includes a plurality of heads 101, and each of the heads 101 includes a nozzle array comprised of an arranged plurality of nozzles. The heads 101 are arranged in a zigzag pattern in a direction intersecting a paper conveying direction (here, in a direction perpendicular to the paper conveying direction). Each color of the recording heads 51 is comprised of the plurality of heads 101 (for example, there are ten heads 101 in FIG. 3) in two rows arranged in a zigzag shape. Hereinafter, an array direction of the heads 101 may be called "a head array direction", and a whole array of the plurality of nozzles arranged in the direction crossing the paper conveying direction may be called "a nozzle array in the recording head 50".

Figure 4:
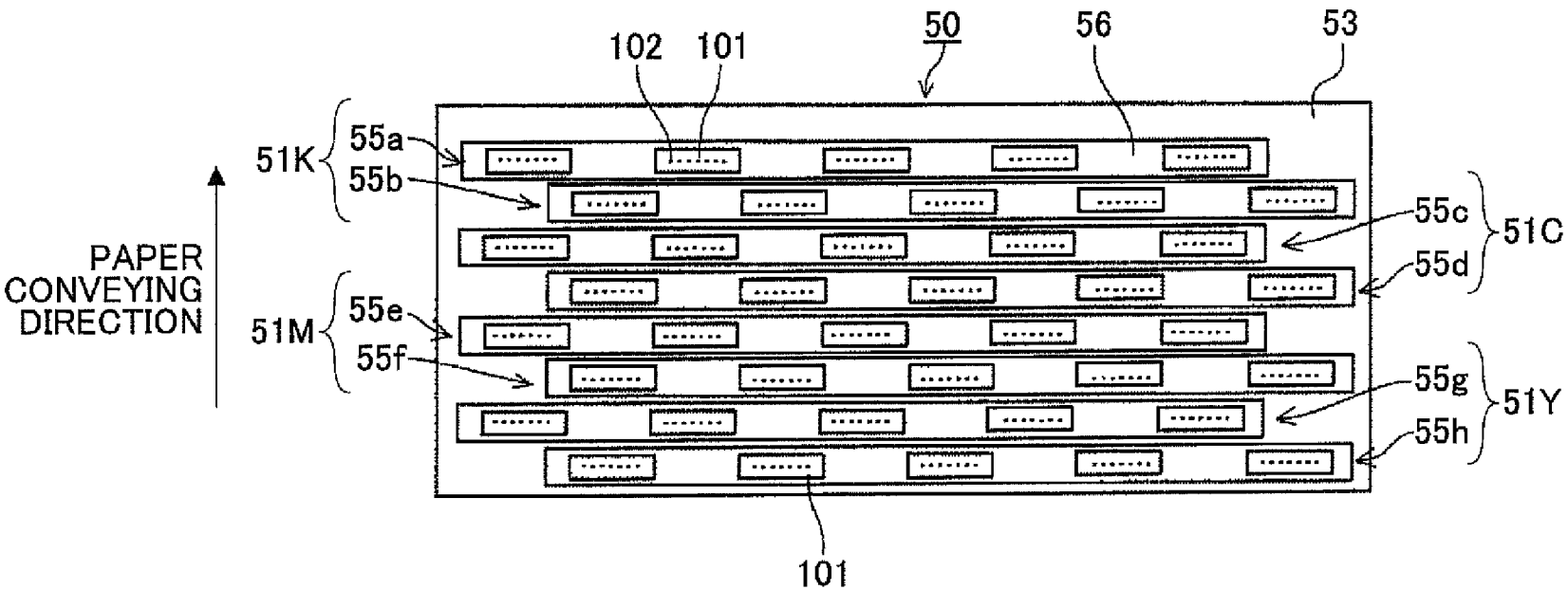
FIG. 4 is an illustration diagram showing another example of the head module in the first embodiment of the present invention.

Moreover, the head module array 50 does not limit the above-mentioned configuration. For example, as shown in FIG. 4, eight head modules 55*a*-55*h* may be arranged along the paper conveying direction on the common base member 53. Each of the head modules 55*a*-55*h* includes a plurality of heads 101 (for example, there are five heads 101 in this example) arranged on a base member 56. The head modules 55*a*-55*h* are arranged so that the heads 101 are arranged in a zigzag formation between adjacent head modules 55.

Figure 5:
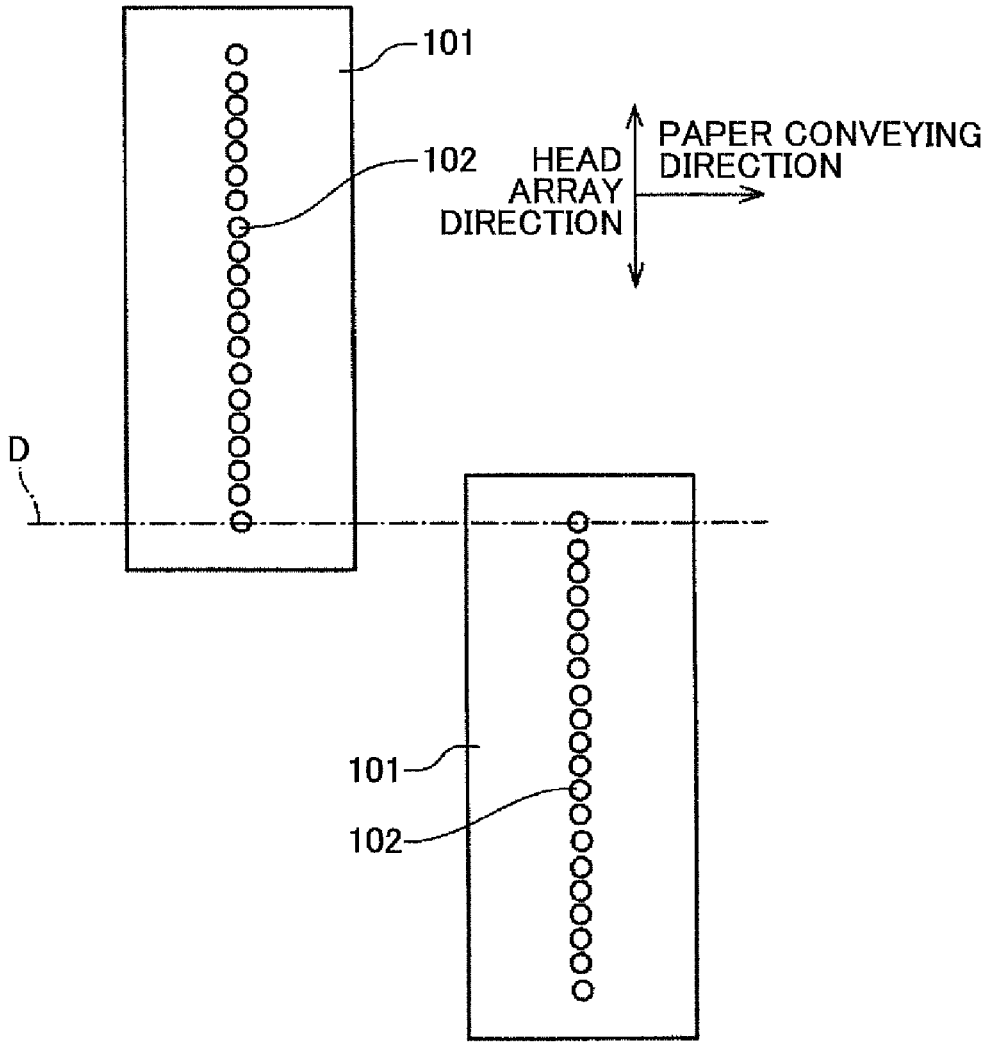
FIG. 5 is an outline illustration diagram to explain an overlapping part between heads in the first embodiment of the present invention.

In addition, as shown in FIG. 5, the heads 101 are arranged so that one or more than one nozzle 102 of an end of each of two heads 101 adjacent in the head array direction overlaps each other in the paper conveying direction. By doing this, the nozzles 102 of the two heads can carry out recording on the same record position (i.e., dot position).

Returning to FIG. 1 and FIG. 2, the following explanation is given. In FIG. 1, on the upstream side of the pair of resist rollers 23 in the paper conveying direction (which may be called hereinafter just "upstream side"), a first paper detection part 11 is located to control a drive timing of the pair of paper feed rollers 22 that separates each paper sheet P and feed, and to read a position and a size of the paper sheet P. On the upstream side of the image forming unit 5, a recording position detection part 12 is located to determine a droplet discharge timing from the recording head 51 and to detect a back end of the paper sheet P. On the downstream side of the image forming unit 5, a second paper detection part 13 that reads a position of the paper sheet P is disposed. Above the driving roller (i.e., conveying roller) 41, a paper back end detection part 14 is disposed to detect a paper jam of the paper sheet P and to determine a feed timing of the next paper sheet P.

Moreover, as shown in FIG. 2, a belt-reference-hole-array-recognition mark (i.e., marker) 17 is provided on the conveyor belt 43. Also, as shown in FIG. 1 and FIG. 2, a belt-reference-hole-array-detection sensor 16 that detects the belt-reference-hole-array-recognition mark 17 is located.

Figure 6:
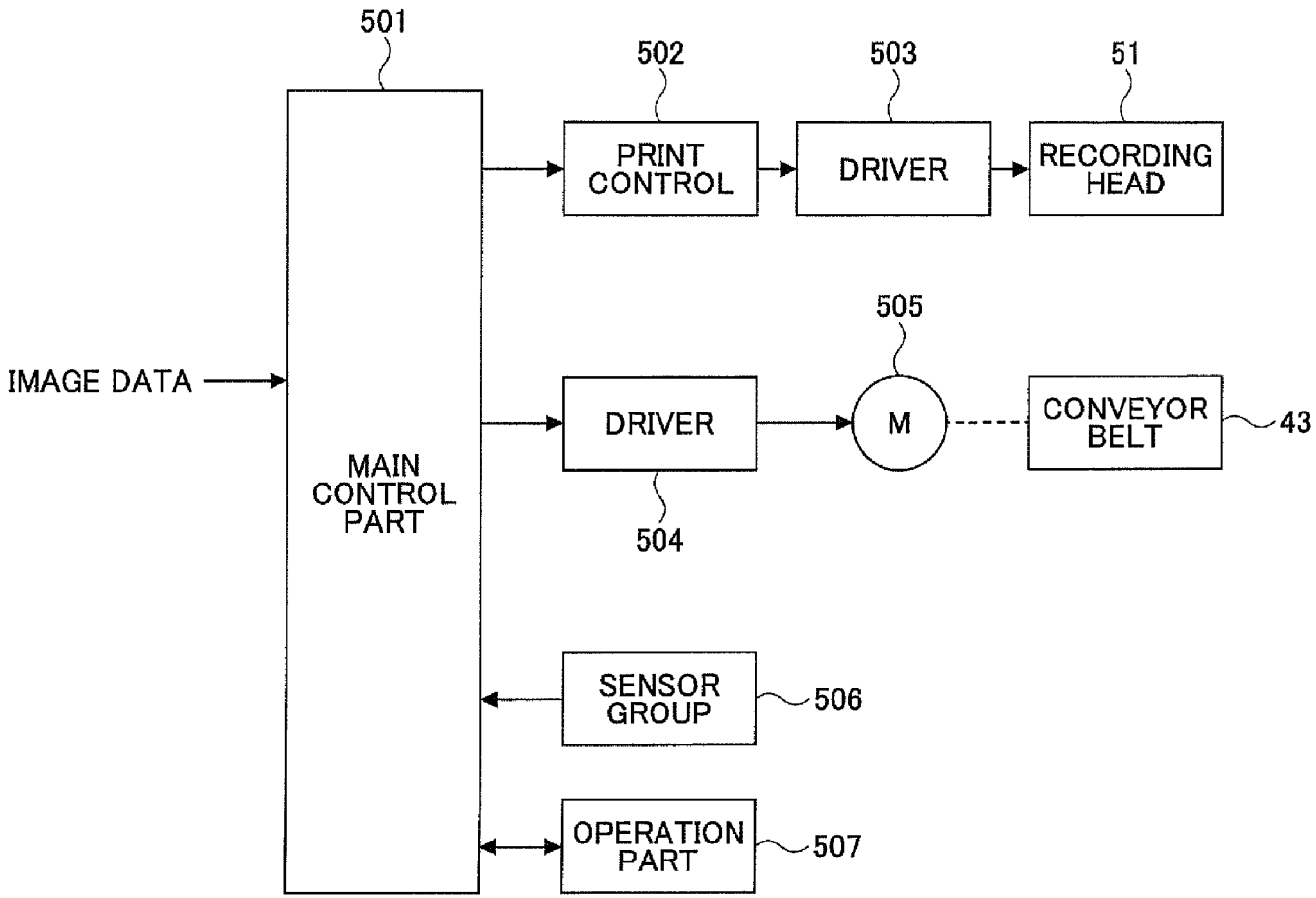
FIG. 6 is an illustration block diagram showing an outline of a control part in the first embodiment of the present invention.

Next, an outline of a control part of the image forming apparatus is explained by referring to a block illustration diagram of FIG. 6.

This control part includes a micro computer that controls the entire image forming apparatus and also functions as a control unit to perform controls involving a blank discharging of the present invention. The control part also includes an image memory and a main control part (i.e., system controller) 501 including a communication interface. The main control part 501 outputs and sends printing data to a print control part 502 in order to form an image on the paper sheet P based on image data and a variety of command information transferred from an outside information processor (for example, processor of a host side) and so on.

The print control part 502 generates data to drive a pressure generation unit for discharging the droplets from the nozzle 102 of the recording head 51, and transfers various signals necessary for transfer of the data and determination of the transfer to a head driver 503. The print control part 502 includes a memory part that works as a driving waveform data storing unit, a D-A converter that converts digital data of the driving waveform into analog data of the driving waveform, and a selection unit that selects the driving waveform provided for the head driver 503. The print control part 502 generates the driving waveform comprised of a driving pulse (i.e., driving signal) or a plurality of driving pulse, and outputs the driving waveform or the plurality of driving pulse to the head driver 503, by which the recording head 51 is driven and controlled.

Moreover, the main control part 501 drives and controls a paper conveying motor 505 that revolves the conveyor belt 43 and a motor (which is not shown in FIG. 6) to drive the suction fan 44 via a motor driver 504. The main control part 501 also drives and controls a paper feed motor that feeds the paper sheet P from the paper feed part 2, but the paper feed motor is omitted in FIG. 6.

Furthermore, a sensor group 506 including the above-mentioned various detection parts, sensors 11-16 and other various sensors, inputs a detection signal into the main control part 501. Also, the main control part 501 performs input and output of a variety of information, and communicates display information with an operation part 507.

Next, an image forming operation of the image forming apparatus is explained as follows.

Image data to be printed are input into the main control part 501 through a communication interface in the main control part 501 from an external information processor and stored in an internal image memory. The main control part 501 drives the pair of paper conveying rollers 22 by using a paper feed driving part not shown in drawings, separates the top paper sheet P, feeds the paper sheet P to the pair of resist rollers 23 and begins to revolve the conveyor belt 43 at a predetermined timing.

Then, when the main control part 501 receives a paper detection signal from the paper detection part 11, after a predetermined timing, the main control part 501 drives the pair of resist rollers 22 and sends forth the paper sheet P to the conveyor belt 43.

After that, when a sensor part of the recording position detection part 12 detects an arrival of a front end of the paper sheet P, the main control part 501 forms an image on the conveyed paper sheet P by discharging droplets from each recording head 51 onto the paper sheet P, according to the image data at the predetermined timing. More specifically, the image data stored in the image memory not shown in drawings are transferred to the print control part 502 and converted into dot data of each color. The recording head 51 is driven based on the dot data via the head driver 503, by which the nozzle 102 discharges necessary droplets.

In addition, the droplet discharging timing of the recording head 51 is controlled by synchronizing the conveying rate of the paper sheet P based on a detection result from the recording position detection part 12, which makes it possible to form an image on the paper sheet P without stopping the conveyance of the paper sheet P.

Then, the paper sheet 2 including the image formed on itself is continuously conveyed by the conveyor belt 43 and is ejected on the catch tray 31 of the paper ejection part 3.

Next, a configuration relating to the blank discharging of the image forming apparatus is explained.

To begin with, in FIG. 2, the conveyor belt 43 includes a plurality of suction holes 201 arranged to pass a position facing all the nozzle 102 in the recording head 51. Here an array of the suction holes 201 in the head array direction is called "a suction hole array". In this example, suction hole arrays A1-A5 (which are called "a suction hole array A" when each of the suction hole arrays A1-A5 are not distinguished) and suction hole arrays B1-B4 (which are called "a suction hole array B" when each of the suction hole arrays B1-B4 are not distinguished) are repeatedly arranged at a predetermined pitch from the downstream to the upstream in the paper conveying direction, that is, from right to left in FIG. 2.

Moreover, as shown in FIG. 2, both the suction hole array A, B are arranged so that the centers of the suction holes 201 are on the virtual line segment that has a predetermined angle θ to the paper conveying direction. Also, both the suction hole arrays A, B are arranged at predetermined intervals in a direction perpendicular to the paper conveying direction, which allows nine total arrays of the suction hole arrays A1-A5, B1-B4 to cover and pass the positions facing all the nozzles 102 in each of the recording heads 51, in the first embodiment.

In addition, since sizes of all of the suction holes 201 (i.e., hole diameter) are all configured to be equal, the number of nozzles 102 discharging to one suction hole 201 is set at a predetermined continuous number. However, regarding the nozzles 102*a* corresponding to the overlapping part generated by the zigzag form arrangement of the heads 101 in each recording head 51 (i.e., the overlapping part in the nozzle array direction), and the nozzle 102*b* of an end of the nozzle array in a less frequently used recording head 51 (here nozzle 102*b* means an end nozzle of the nozzle array), the number of nozzles 102 is set to be half of the above-mentioned predetermined continuous number. Here the nozzle 102*a*, 102*b* is not necessary to be one, more than one nozzle 102*a* is overlapped in a direction of the nozzle arrays. In that case, the plurality of overlapping nozzles are called a nozzle 102*b*. In a similar way, there is not necessarily one nozzle 102*b* but there can be more than one nozzle 102*b* by the relationship with the blank discharging.

More specifically, the nozzles 102*a* corresponding to the overlapping part of the heads 101 perform the blank discharging from half of the nozzles 102 other than the overlapping part in each head 101 of the upstream and the downstream in the paper conveying direction. As a result, the number of the nozzles 102*a* performing the blank discharging in the overlapping part is set to be equal to the number of the nozzles performing the blank discharging other than the overlapping part.

In addition, the suction hole arrays A, B are arranged as the suction holes A1, B1, A2, B2, . . . , following the suction hole A5 at a similar arrangement, though the suction holes after A2 are not shown in FIG. 2.

Moreover, in the suction hole array A1 among the suction hole arrays A, B, a center of the hole 201 is set on a line segment C running through the nozzles 102*a* in the paper conveying direction. Also, a center of the hole 201 is set on a line segment D running through the nozzles 102*h* in the paper conveying direction. Here the nozzle 102*a* corresponds to the overlapping part of two heads 101 created by the zigzag arrangement of each head 101, and the nozzle 102*b* is an end nozzle of the head array direction (i.e., an end of the recording head 51) less frequently used. In FIG. 2, the corresponding suction holes 201 are expressed by a heavy line.

Then, the suction hole array A1 including the suction holes 201 that pass the positions of nozzles 102*b* of the end of the recording head 51 and nozzles 102*a* in the overlapping part in the head array direction, are made a reference suction hole array (i.e., a reference hole array). To detect a position of the reference hole array A1, the above-mentioned belt-reference-hole-array-recognition mark 17 is provided at an inner end (i.e., an end in the head array direction) on the conveyor belt 43. The belt-reference-hole-array-detection sensor 16 detects the belt-reference-hole-array-recognition mark 17. The belt-reference-hole-array-recognition mark 17 are provided at intervals corresponding to the suction hole array (i.e., reference hole array) A1 formed and disposed at intervals over the whole circumference of the conveyor belt 43 in a similar way.

Furthermore, in the first embodiment, with regard to an arrangement of the suction holes 201, a way of an arrangement of the suction holes 201 in a suction hole array B4 is identical with the way of an arrangement of the suction holes 201 in a suction hole array A1. The suction holes 201 in a suction hole array B4 are expressed in a heavy line as well as the suction holes 201 in a suction hole array A1. Here since the suction holes 201 on the conveyor belt 43 are provided to suction and carry the paper sheet P, and the arrangement of the suction holes 201 is set to be uniform, the suction hole array arising from the arrangement such as the suction hole array B1 is not particularly needed to be used as the suction hole 201 performing the blank discharging. The suction hole array such as the suction hole array B1 may be used only as the suction holes for the paper suction. Also, a suction hole 201 facing the nozzles 102*a* corresponding to the overlapping part, or facing the less frequently used end nozzle 102*b* in the recording head array direction among the suction hole array B4, can be used for performing the second blank discharging, which allows a discharging state of the nozzle 102 in those areas to be stable.

Next, the blank discharging operation of the image forming apparatus is explained.

While the image forming apparatus is printing or waiting, if the use frequency of a certain nozzle 102 decreases and a state where an ink droplet is not discharged for more than a predetermined time continues, there occurs a phenomenon where ink solvent around the nozzle 102 evaporates and ink viscosity increase. Under such condition, even if the actuator unit (which is not shown in drawings) is driven in the head 101, nozzle 102 cannot discharge the ink droplet. Before the condition develops, the main control part 501 drives the head 101 and the actuator unit in a range of viscosity capable of discharging, and performs the blank discharging to discharge the deteriorated ink (i.e., the ink adjacent nozzle 102 with increased viscosity). Also, the control by the main control part 501 is performed so that the blank discharging is executed after passing a predetermined elapsed time of non-operational nozzle 102 or a predetermined recording number.

More specifically, if the recording operation is carried out continuously until reaching the predetermined elapse time or recording number, the main control part 501 (i.e., system controller) continues to detect the front end of the next conveyance paper sheet P. After the back end of the paper sheet P being conveyed at the moment passes the detection position of the recording position detection part 12, the main control part 501 transfers driving data in accordance with a blank discharging pattern from the print control part 502 to the driver 503, and makes the nozzle in the recording head 51 discharge the blank discharging droplet not contributing to the recording.

Thus, by utilizing a conveyance interval between the back end of the paper sheet P currently being conveyed and the front end of the next conveyance paper sheet P, when an empty space between the paper sheets P arrives at a position facing the nozzles 102 in the recording head 51, the main control part 501 makes the nozzles 102 in the recording head 51Y discharge the blank discharging droplet to each suction hole 201 arranged on the conveyor belt 43 between the paper sheets P so as to pass the position facing the nozzles 102 in the recording head 51.

Thus, the blank discharging droplet discharged to the suction hole 201 on the conveyor belt 43 passes the suction hole 201 on the conveyor belt 43 and a through-hole provided for the deflection preventing member 45, and lands on the blank discharging ink receiver 46 disposed under the deflection preventing member 45. By this, unused and dried ink or deteriorated ink with changed viscosity is removed from the nozzle 102 in the recording head 51.

Next, after the nozzles 102 in the recording head 51 conduct the blank discharging, in a similar way, as the suction holes 201 on the conveyor belt 43 move to the position facing nozzles 102 of each recording head 51M, 51C, 51K, the nozzles 102 in each recording head 51M, 51C, 51K discharge the blank discharging droplet.

At this time, the main control part 501 controls a droplet discharge timing so that the other recording heads 51M, 51C, 51K discharge the blank discharging droplet almost to the identical spot with the suction hole 201 on the conveyor belt 43 to which the recording head 51Y discharged the blank discharging droplet. In other words, based on the detection result from the recording position detection part 12, toward the suction hole 201 on the conveyor belt 43, each neighboring recording head 51M, 51C, 51K sequentially discharges the blank discharging droplet to almost the same position as the blank discharging position by the recording head 51Y. Here a way of delaying the timing of the blank discharging of each recording head 51 is the same as a way of delaying the timing of each recording head 51 in usual printing. A different point between the usual printing and the blank discharging operation is that the blank discharging operation goes by the detection signal of the back end of the paper sheet P, while the usual printing goes by the detection signal of the front end of the paper sheet P.

Figure 7:
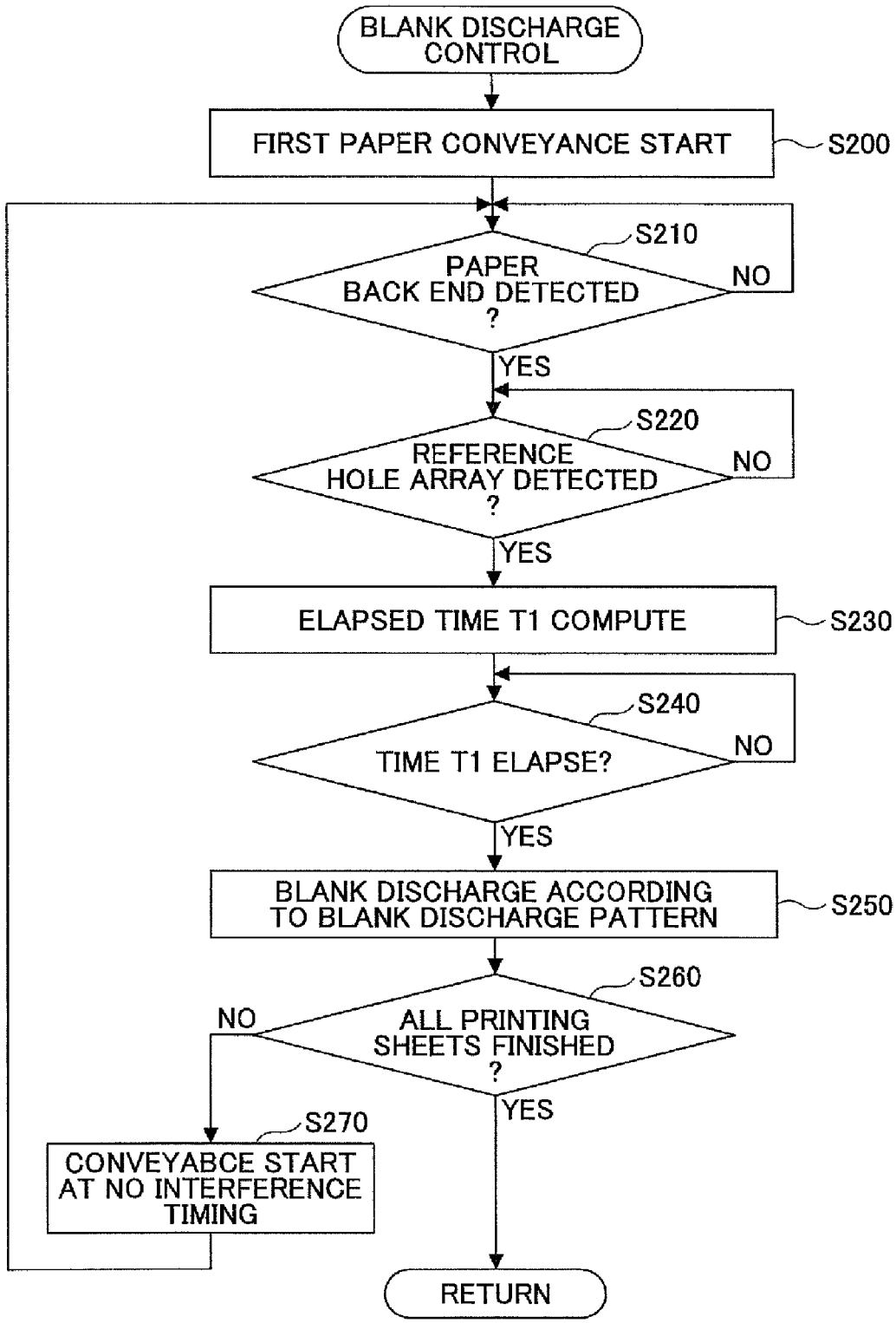
FIG. 7 is a flow chart diagram to explain a control of a blank discharging operation in the first embodiment of the present invention.

Next, with regard to a control of the blank discharging operation by the main control part 501, an explanation is given by referring to a flow chart shown in FIG. 7.

As mentioned-above, in the reference hole array A1, a center of the suction hole 201 is set on each of line segments C and D parallel to the conveying direction, running through the nozzle 102*a* corresponding to the overlapping part created from the zigzag arrangement of each head 101 or the less frequently used nozzle 102*b* of the end of the head array direction (as shown in FIG. 2). In the following explanation, FIG. 2 may be referred to, if necessary.

In step S200, the main control part 501 starts to convey the first (which includes "preceding") paper sheet Pf. In step S210, the main control part 501 determines whether the recording position detection part 12 detects the back end Pfb of the first paper sheet Pf. When the back end Pfb of the first paper sheet Pf is detected by the recording position detection part 12, the flow proceeds to step S220. In step S220, the main control part 501 determines whether the belt-reference-hole-array-detection sensor 16 detects the belt-reference-hole-array-recognition mark 17.

In step S220, when the belt-reference-hole-array-recognition mark 17 on the conveyor belt 43 is detected by the belt-reference-hole-array-detection sensor 16, the flow advances to step S230. In step S230, the main control part 501 obtains an elapse time T1 until the reference hole array A1 reaches the position facing the first recording head 51Y by an operation. In step S240, the main control part 501 determines whether the elapse time T1 has passed since the belt-reference-hole-array-detection sensor 16 detected the belt-reference-hole-array-recognition mark 17.

In step S240, when the elapse time T1 has passed and the reference hole array A1 reaches the position facing the first recording head 51Y, that is, after the elapse time T1 has passed since the reference hole array A1 was detected, the flow proceeds to step S250. In step S250, the main control part 501 makes the recording head 51Y perform the blank discharging toward each suction hole 201 of the reference hole array A1 based on the blank discharging pattern, making the reference hole array A1 the top.

In the reference hole array A1, as presented above, since a center of the suction hole 201 is arranged on line segments C and D parallel to the conveying direction running through the nozzles 102*a* corresponding to the overlapping part generated from the zigzag arrangement of each head 101, or the less frequently used nozzle 102*b* of the end in the head array direction, the blank discharging is certainly performed from the nozzles 102*a*, 102*b* in those areas. Moreover, if the suction hole 201 corresponding to the areas other than those areas is provided in the reference hole array A1, the blank discharging can also be performed from the nozzle 102 facing the suction hole 201.

The main control part 501 stores a blank discharging pattern corresponding to the nine arrays including each suction hole array A1-A9, B1-B4, starting from the suction hole array A1 (i.e., reference hole array) to the suction hole array A5. The blank discharging is set to be carried out according to the blank discharging pattern. However, as discussed above, regarding the nozzles 102*a* corresponding to the overlapping part of the head 101 or the less frequently used nozzle 102*b* of the end in the head array direction, in order to keep a discharging state of the nozzles 102*a*, 102*b* in the areas preferable, it is possible to make the blank discharging pattern for performing the second blank discharging.

Then, after the reference hole array A1 passes, the suction holes 201 in each suction hole array sequentially arranged on the conveyor belt 43 such as the suction hole arrays B1, A2, B2, . . . , pass the position facing the recording head 51Y. During this time, the main control part 501 calculates the time until each suction hole array reaches the position facing the recording head 51Y, going by the timing when the reference hole array A1 reaches the position facing the recording head 51Y. The main control part 501 controls the blank discharging so that the corresponding nozzle 102 in the recording head 51Y performs the blank discharging toward each suction hole 201 of each suction hole array after the suction hole array B1, according to the blank discharging pattern at the calculated timing.

Regarding the other recording heads 51M, 51C, 51K, the blank discharging control is carried out and the blank charging from all of the nozzles 102 is finished.

After that, in step S260, the main control part 501 determines whether the printing has been performed for all the paper sheets P. In step S260, if all the paper sheets P for printing have not been printed, the flow proceeds to step S270. In step S270, the main control part 501 starts to convey the following paper sheet Ps at a timing when the front end of the following paper sheet Psa does not interrupt the last suction hole array A5 (i.e., the ninth array) of the suction hole array to which the blank discharging is performed. In step S260, all the paper sheets P have been printed, the flow finishes and returns to the top of the flow.

Here, when two kinds of suction holes provided on the conveyor belt 43 move in the conveying direction, the condition where the blank discharging is conducted to the suction holes is explained, referring to FIG. 8A through FIG. 8D. The two kinds of suction holes are a suction hole each facing the nozzles 102*a* corresponding to the overlapping part created by the zigzag arrangement of the head 101 and the less frequently used nozzle 102*b* of the end of the head array direction. In FIG. 8A through FIG. 8D, a nozzle 102 performing the blank discharging is expressed by a black circle. Also, in general, a droplet discharged by the blank discharging becomes a plurality of droplets, but the plurality of droplets are omitted in FIG. 8.

Figure 8A:
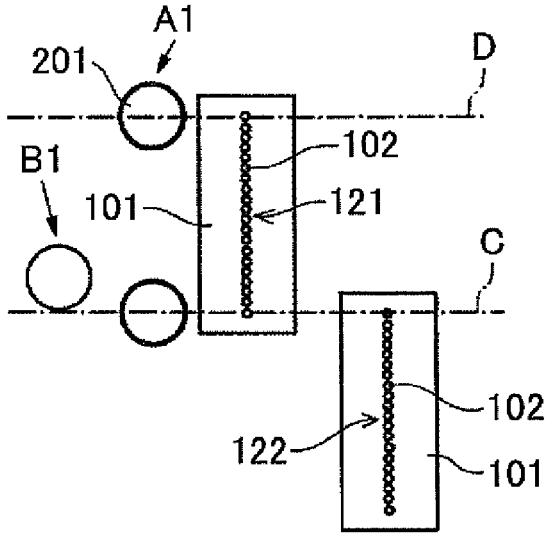
FIGS. 8A-8D are a main part illustration diagram to concretely explain control of the blank discharging operation in the first embodiment of the present invention.
Figure 8B:
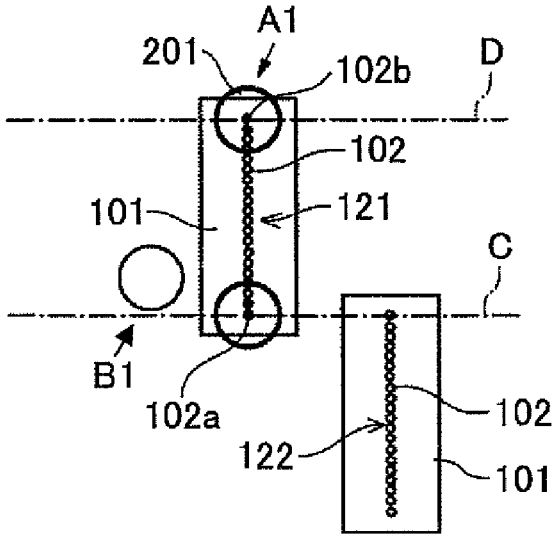

First, as shown in FIG. 8A, the reference hole array A1 provided on the conveyor belt 43 is in a state just before the reference hole array A1 reaches the nozzle array 121 that performs the first blank discharging. By moving the conveyor belt 43 from the state, as shown in FIG. 8B, the reference hole array A1 gets to the nozzle array 121, and the two nozzles 102*a* of the overlapping part and the two nozzles 102*b* of the ends in the head array direction carry out the blank discharging.

Figure 8C:
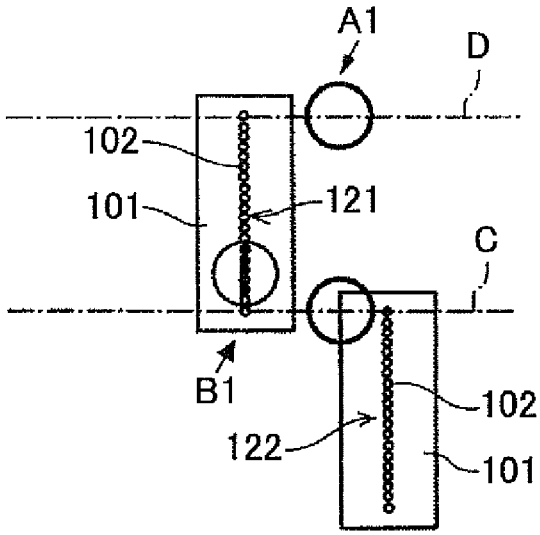
Figure 8D:
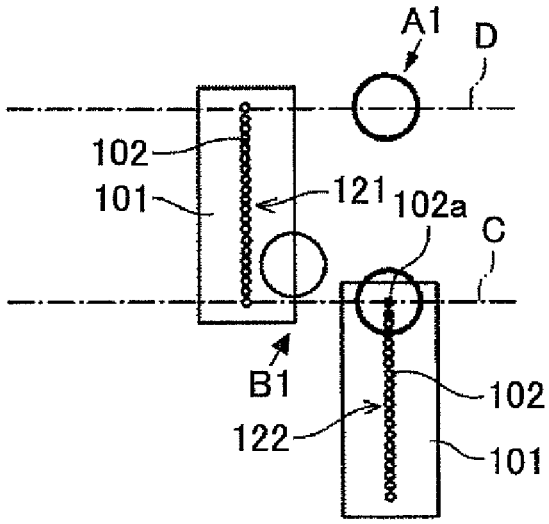

Next, as shown in FIG. 8C, the next suction array B1 following the reference hole array A1 reaches the nozzle array 121, and four facing nozzles 102 perform the blank discharging to the suction hole array B1. Furthermore, as shown in FIG. 8D, two nozzles 102 of the overlapping part in the next head 101 arranged in the zigzag form conduct the blank discharging to the reference hole array A1.

Thus, at least one of the plurality of suction hole arrays provided on the conveyor belt 43 is the reference hole array A1 including the suction hole passing the position facing the end nozzle 102*b* of the nozzle array in the recording heads 51 or the nozzle 102*a* of the overlapping part in the nozzle array direction of the two heads 101. Each nozzle 102 in the recording head 51 discharges the blank discharge droplets toward the suction hole 201 referring to the reference hole array A1 as a standard, which makes it possible to perform the blank discharging easily preventing the end nozzle 102*b* in the nozzle array in the recording head 51 or the nozzle 102 of the overlapping part of each head 101 from performing the blank discharging at the discrete timing.

More specifically, on the conveyor belt 43, because the suction hole 201 is arranged by locating the position facing the nozzle 102*a* corresponding to the overlapping part generated from the zigzag arrangement of each head 101 constituting the recording head 51 and the less frequently used nozzle 102*b* of the end of the recording head 51, those nozzles 102*a*, 102*b* can certainly carry out the blank discharging.

In this case, in a suction hole array arranged in the same direction to the head array direction, the suction holes 201 may be arranged to face all the nozzles 102*a* corresponding to the overlapping part of each head 101 arranged in the zigzag form and all of the less frequently used nozzles 102*b* of the ends of the recording head 51. This makes it possible to finish the blank discharging once in a short time if only a suction array passes under each head 101 of a pair of heads 101 arranged in the zigzag form.

Moreover, if the recording heads 51 discharging different color droplets in the downstream of the paper conveying direction are arranged in a similar way to each head 101 of the first pair of heads 101, as the conveyor belt 43 moves, all nozzles 102*a* corresponding to a similar overlapping part to the same suction hole 201 and all less frequently used nozzles 102*b* of ends of the recording head 51 can conduct the blank discharging.

Furthermore, by providing a plurality of suction hole arrays including the reference hole array A1 in a predetermined frequency on the conveyor belt 43, and by performing the paper conveyance control so that the timing of the paper conveyance becomes the downstream of a predetermined suction hole 201 among the plurality of suction hole arrays including the more than one reference hole array provided in the predetermined frequency, conducting the blank discharging just after the back end of the paper sheet P passes is possible, which also makes it possible to prepare printing for the following paper sheet P. Also, even if the predetermined suction hole array is conveyed being covered with the paper sheet P, since the suction hole array capable of the blank discharging definitely appears in the next frequency, the waiting time for the blank discharging can be shortened.

In addition, by providing a mark to detect the reference hole array on the conveyor belt 43 and by detecting the mark, determining whether the suction hole array exists just upstream of the paper sheet P becomes possible, which allows the timing of the blank discharging to be controlled precisely. Furthermore, by the detection of the reference hole array, the paper conveyance can be controlled so that the following paper sheet P does not interrupt the suction hole 201 provided with the blank discharging.

Figure 9:
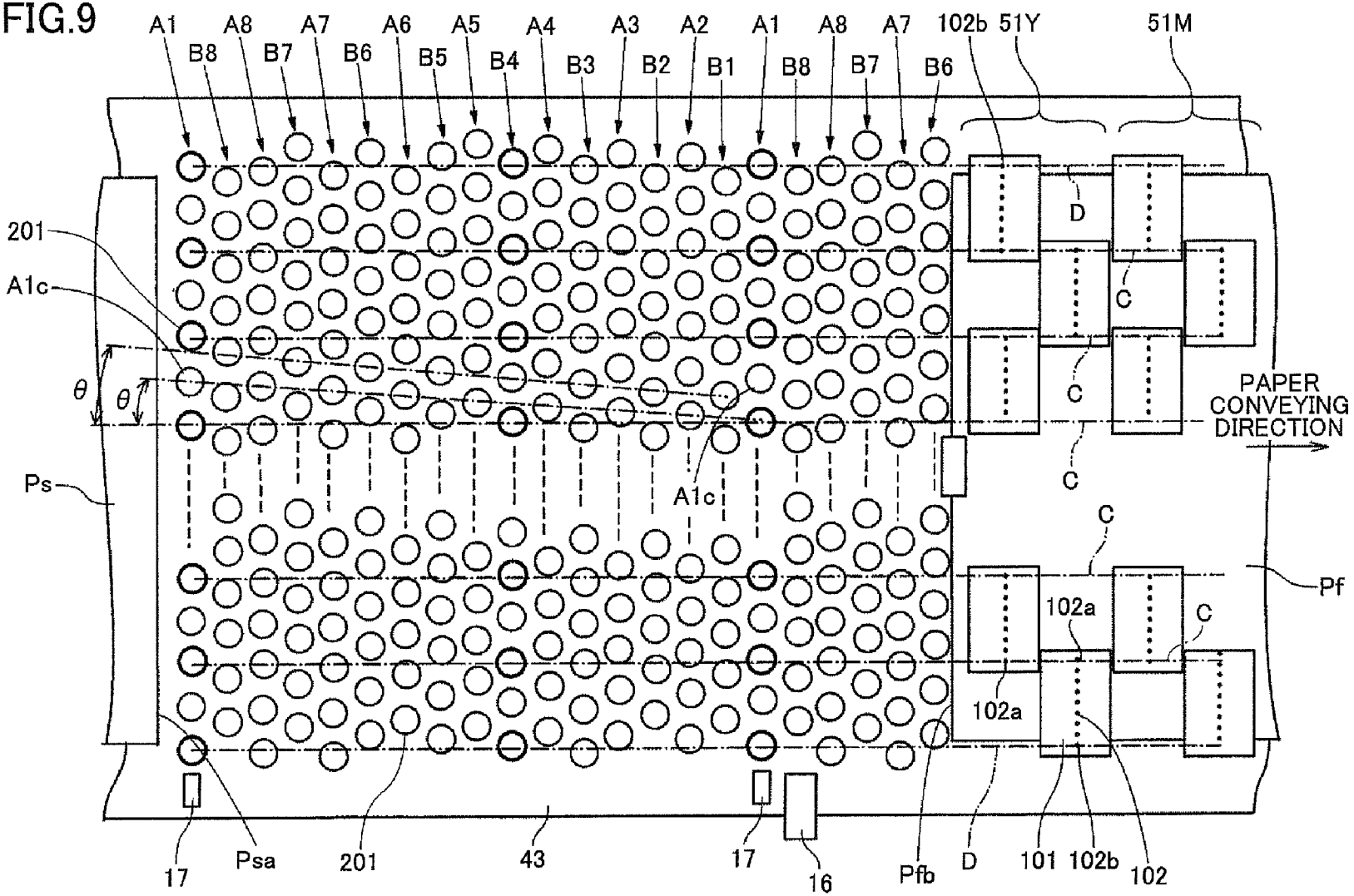
FIG. 9 is a plane illustration diagram to explain an image forming apparatus in a second embodiment of the present invention.

Next, another embodiment (i.e., a second embodiment) of the present invention is explained referring to FIG. 9. FIG. 9 is a plane illustration diagram similar to FIG. 2 of the second embodiment of the present invention.

In the second embodiment, in a reference hole array A1, as shown in FIG. 2 of the first embodiment, a center of a suction hole 201 is provided so that the suction hole 201 passes a position facing a nozzle 102*a* corresponding to an overlapping part created by a zigzag arrangement of each head 101, or a less frequently used nozzle 102*b* of an end of a head array direction. As the explanation is given in the first embodiment, other suction holes than the above-mentioned suction hole 201 may be included in the reference hole array A1.

Regarding an arrangement of the suction hole array, as shown in FIG. 2 in the first embodiment, the suction hole array A5 and the upstream suction hole array A1 are discontinuously arranged. However, in the second embodiment, as shown in FIG. 9, both suction hole arrays A, B are arranged so that the centers of the suction hole arrays are on a virtual line segment C, D that has a predetermined angle θ to the paper conveying direction. In addition, the angle θ is set so that the virtual line segment C, D runs through a center of a suction hole A1*c* arranged in the middle of a pair of suction holes 201 in the next suction hole array A1, corresponding to a nozzle 102*a* corresponding to the overlapping part generated from the zigzag arrangement of each head 101. Those suction holes' 201 arrangement is different from that of the first embodiment.

In the first embodiment, as shown in FIG. 2, it is necessary for the nine arrays from the reference hole array A1 to the suction hole array A9 to pass the position facing all the nozzles 102 in the recording head 51 and to finish the blank discharging. However, in the second embodiment, because of the above-mentioned arrangement as shown in FIG. 9, it is possible for any array among a total of sixteen arrays, including suction hole arrays A1-A8, B1-B8, to start the blank discharging, to pass positions facing all the nozzles 102 in each recording head 51 and to finish the blank discharging.

In addition, since the arrangement makes it possible to perform a blank discharging operation just after a back end Pfb of a preceding paper sheet Pf, minimizing a distance to a front end Psa of the following paper sheet Ps becomes possible, which can also improve printing productivity.

Moreover, by shortening dimensions between each suction hole array, the above-mentioned distance between the back end Pfb of the preceding paper sheet Pf and the front end Psa of the following paper sheet Ps can be reduced. Furthermore, in the second embodiment shown in FIG. 9, one suction hole A1*c* is provided between the two suction holes 201 in the overlapping part of the heads 101. However, making a layout that includes a plurality of suction holes A1*c* between the two suction holes 201 in the overlapping part is possible, which can reduce a necessary number of the hole arrays for conducting the blank discharging from all the nozzles 102 less than the above-discussed nine arrays.

Figure 10:
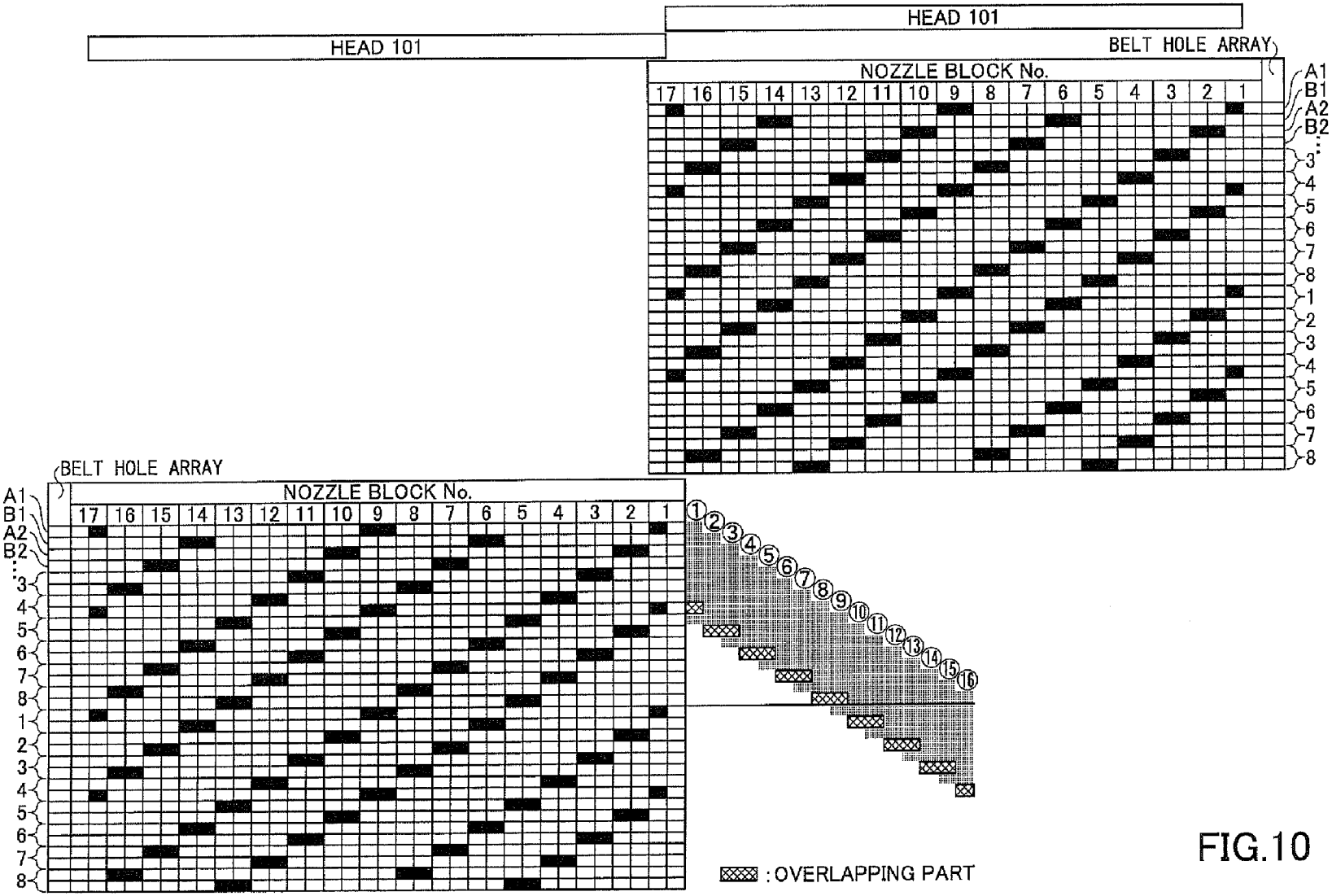
FIG. 10 is an illustration diagram showing an example of a blank discharging pattern in the second embodiment of the present invention.

Here FIG. 10 shows an example of a blank discharging pattern 1-16 corresponding to each suction hole array A1-A8, B1-B8 (which is shown as encircled numbers in FIG. 10) as a whole. The main control part 501 stores the blank discharging pattern 1-16 corresponding to each of nine suction hole arrays, starting from each suction hole array, and executes the blank discharging according to the pattern. In FIG. 10, the nozzles 102 in the recording head 51 are divided into 17 blocks 1-17 (which are expressed as "Nozzle Block No."), and a discharged image corresponding to the suction holes 201 of the suction hole arrays A1-B8 is expressed by being blacked out. In FIG. 10, "Overlapping Part" means a hole array that does not need the blank discharging.

In a concrete blank discharging control, the main control part 501 uses a signal detected by a belt-reference-hole-array-detection sensor 16 based on a belt-reference-hole-array-recognition mark 17 as a standard. In this case, the signal is detected just before the recording position detection part 12 detects the back end Pfb of the preceding paper sheet Pf. Here if a time elapsing from the standard timing to the detection of the back end Pfb of the paper sheet Pf is expressed as "T2", and if a time elapsing from the detection of the belt reference hole array to the detection of the following belt reference hole array is expressed as "T3", blank discharging data selected by the main control part 501 are shown in FIG. 11.

FIG. 11 depends on the arrangement example of the suction hole arrays shown in FIG. 9. There are various data patterns depending on a mutual positional relationship between the recording position detection part 12 and the belt-reference-hole-array-detection sensor 16. If the recording position detection part 12 and the belt-reference-hole-array-detection sensor 16 are arranged in a direction perpendicular to the paper conveying direction, there is no problem on the blank discharging control.

If the main control part 501 selects the nearest suction hole to the back end of the paper sheet P (for example, the suction hole array B6 corresponds in FIG. 9), a time until the suction hole array B6 reaches a position facing the first recording head 51Y is calculated by an operation. Then, at a timing after the calculated time has elapsed, the recording head 51Y begins the blank discharging toward a suction hole 201 in the suction hole array B6. In this case, to be more precise in FIG. 10, the main control part 501 selects the pattern 12, and performs the blank discharging corresponding to the nine arrays of the suction hole array B6-82.

Also in this case, the above-mentioned nine arrays include at least one of the suction hole arrays (i.e., reference hole array A1) facing the nozzles 102*a* corresponding to the overlapping part created by the zigzag arrangement or the less frequently used nozzles 102*b* of the end in the head array direction. The nozzles 102*a*, 102*b* in those areas certainly carry out the blank discharging as well as the first embodiment. In the nine arrays, except the suction array facing the nozzle 102*a* corresponding to the overlapping part and less frequently used nozzle 102*b* of the end of the array, there is a suction hole facing the identical nozzles in terms of the suction hole arrangement. However, in this case, the blank discharging data are configured so that the identical nozzles do not perform the blank discharging only to the suction hole.

Regarding the other recording heads 51M, 51C, 51K, the blank discharging control is performed in a similar way, and the blank discharging from all the nozzles finishes. Moreover, the main control part 501 controls the conveyance start timing and conveys the paper sheet P so that the front end of the following paper sheet P does not interrupt the ninth suction hole array, the last array of the suction hole arrays that the nozzles performs the blank discharging.

In the above-mentioned explanation, the suction hole array B6 is selected as the top suction hole array to which the nozzles 102 conducts the blank discharging. However, to stay on the safe side about arithmetic processing, selecting the suction hole A7 following the suction hole B6 is possible.

Figure 12:
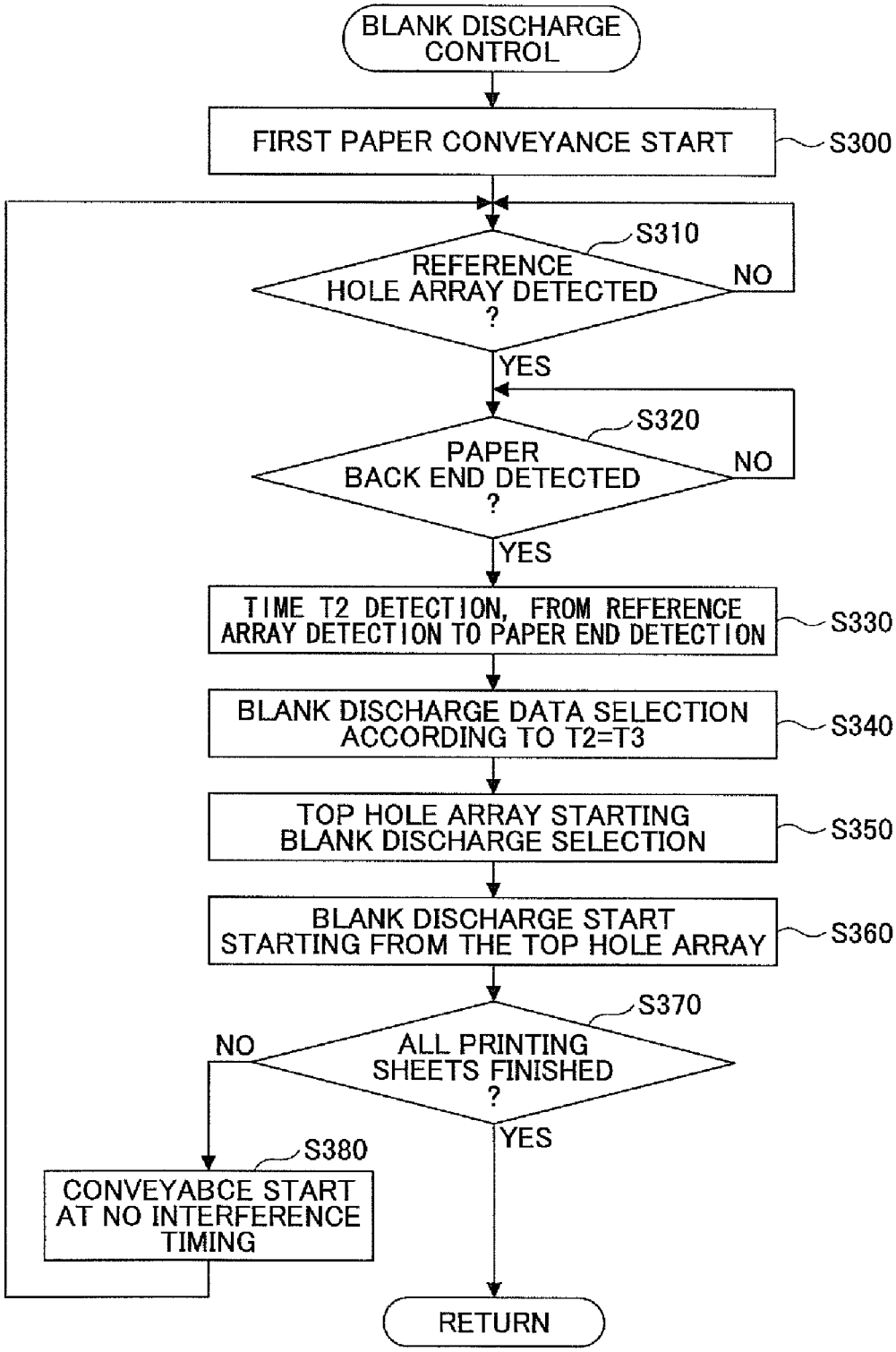
FIG. 12 is a flow chart to explain a control of a blank discharging operation in the second embodiment of the present invention.

Next, the control of the blank discharging operation is explained referring to a flow chart shown in FIG. 12. In the explanation, FIG. 9 also may be referred to if necessary.

In step S300, the main control part 501 starts to convey the first paper sheet Pf. In step S310, the main control part 501 determines whether the belt-reference-hole-array-detection sensor 16 detects the belt-reference-hole-array-recognition mark 17. In step S310, if the belt-reference-hole-array-recognition mark 17 is detected, the flow proceeds to step S320. In step S320, the main control part 501 determines whether the recording position detection part 12 detects the back end Pfb of the first paper sheet Pf.

In step S320, if the back end Pfb of the first paper sheet Pf is detected by the position detection part 12, the flow advances to step S330. In step S330, the time since the reference hole array A1 is detected until the back end of the paper sheet Pf is measured. In step S340, the discharging data in accordance with the time T2=(N/16) T3 (here N=integer number from 4 to 19) is selected. In step S350, the top suction array to which the blank discharging is performed (for example, the suction hole array B6 in FIG. 9) is selected. In step S360, the blank discharging starts, making the selected suction array the top based on the selected blank discharging data.

In step S370, the main control part 501 determines whether a printing process finishes for all the paper sheets P. If all the paper sheets P are not finished, the flow advances to step S380. In step S380, the conveyance of the following paper sheet Ps starts at the timing when the back end of Psa of the following paper sheet Ps does not interrupt the suction hole array B2 (i.e., the ninth array or the array A3 in this embodiment). On the other hand, when the printing process finishes for all the paper sheets P, the flow finishes and returns to the top of the flow.

Thus, according to an image forming apparatus of the embodiments of the present invention, at least one of a plurality of suction hole arrays provided on a conveyor belt is a reference suction hole array including a suction hole that passes a position facing a nozzle in an overlapping part in a nozzle array direction of two heads or a nozzle array end in a recording head, and since each nozzle in the recording head discharges a blank discharging droplet to the suction hole, the blank discharging is readily performed, preventing both end nozzles and nozzles in the overlapping part from performing the blank discharging at a discrete timing.

The present invention is not limited to the specifically disclosed embodiments, and variations and modifications may be made without departing from the scope of the present invention.

The present application is based on Japanese Priority Patent Application No. 2008-264817, filed on Oct. 14, 2008, the entire contents of which are incorporated herein by reference.

What is claimed is:

1. An image forming apparatus comprising:

a recording head including a plurality of heads, each of the heads including a plurality of arranged nozzles to discharge a droplet, wherein the plurality of heads are arranged in a zigzag formation with respect to a nozzle array direction;

a conveyer belt with a plurality of suction holes to convey a printing medium in a direction intersecting a head array direction;

a suction unit to suction the printing medium through the plurality of suction holes of the conveyer belt; and a control unit to control a blank discharging operation to discharge a blank discharging droplet not contributing to image forming from the nozzles when there is no printing medium on the conveyer belt;

wherein a plurality of suction hole arrays, each of the suction hole arrays including the plurality of suction holes arranged in the head array direction, are arranged at a predetermined interval;

wherein at least one of the plurality of suction hole arrays is a reference suction hole array including the suction hole to pass a position facing the nozzle of an end of a nozzle array and the nozzle in an overlapping part of two heads in the nozzle array direction; and wherein the control unit performs a control to make each nozzle in the recording head discharge the blank discharging droplet toward the suction holes, using the reference suction hole array as a standard.

2. The image forming apparatus as claimed in claim 1, wherein the conveyer belt is an endless conveyer belt; and two or more suction hole arrays including the reference suction hole array are arranged at a predetermined pitch across a whole surface of the conveyer belt.

3. The image forming apparatus as claimed in claim 1, wherein the conveyer belt includes a mark to detect a position of the suction hole arrays corresponding to the reference suction hole array.

4. The image forming apparatus as claimed in claim 1, wherein the printing medium is a sheet of paper.

* * * * *